US006651909B1

(12) United States Patent
Bugarin

(10) Patent No.: US 6,651,909 B1
(45) Date of Patent: Nov. 25, 2003

(54) SPRAY NOZZLE RETENTION APPARATUS AND METHOD

(76) Inventor: Adolfo Arteaga Bugarin, 9056 Blue Flag St., Corona, CA (US) 92883

( * ) Notice: Subject to any disclaimer, the term of this patent is extended or adjusted under 35 U.S.C. 154(b) by 0 days.

(21) Appl. No.: 10/153,838

(22) Filed: May 20, 2002

(51) Int. Cl.[7] ..... A62C 31/02
(52) U.S. Cl. ..... 239/390; 239/391; 239/436
(58) Field of Search ..... 239/390.4, 397, 239/436, 442, 289

(56) References Cited

U.S. PATENT DOCUMENTS

| | | | | |
|---|---|---|---|---|
| 630,468 | A | 8/1899 | Quayle | 239/143 |
| 1,179,095 | A | 4/1916 | Hall | 239/383 |
| 1,721,422 | A | 7/1929 | Utz | 239/117 |
| 1,798,709 | A | 3/1931 | Smith | 239/442 |
| 2,711,925 | A | 6/1955 | King | 299/18 |
| 2,928,533 | A | 3/1960 | Loucony | 206/16 |
| 2,944,705 | A | 7/1960 | Strumor | 222/94 |
| 3,081,950 | A | 3/1963 | Rinkewich | 239/394 |
| 3,191,809 | A | 6/1965 | Schultz et al. | 222/182 |
| 3,516,611 | A | 6/1970 | Piggott | 239/391 |
| 3,998,390 | A | 12/1976 | Peterson et al. | 239/394 |
| 4,094,468 | A | 6/1978 | Volle | 239/394 |
| 5,303,869 | A | 4/1994 | Hudson, Jr. | 239/391 |
| 5,590,836 | A | 1/1997 | Thielbar | 239/391 |
| 5,683,035 | A | 11/1997 | Wang | 239/394 |
| 6,105,882 | A | 8/2000 | Woltjen | 239/394 |
| 6,123,272 | A | 9/2000 | Havican et al. | 239/390 |
| 6,179,224 | B1 | 1/2001 | Huesken | 239/152 |
| 6,398,134 | B1 * | 6/2002 | Hickson et al. | 239/394 |

* cited by examiner

*Primary Examiner*—Gregory Huson
*Assistant Examiner*—Amanda Flynn
(74) *Attorney, Agent, or Firm*—Richard L. Myers; Myers Dawes Andras & Sherman LLP

(57) ABSTRACT

A fluid spray apparatus includes a pump providing fluid at an elevated pressure and a delivery system coupled to the pump to spray the fluid in a predetermined configuration. The delivery system includes a flexible hose and a nozzle receiver adapted to receive one of a plurality of nozzles each having an associated spray pattern. A nozzle retainer coupled to the delivery system is adapted to releasably retain the nozzles in proximity to the distal end of the delivery system. An associated method includes the step of retaining the nozzles when not in use in an ordered pattern relative to the retainer and in proximity to the distal end of the delivery system. A nozzle cleaner having a configuration similar to that of the nozzles includes a pin and a guard pivotally mounted to cover the pin.

18 Claims, 3 Drawing Sheets

SPRAY NOZZLE RETENTION APPARATUS AND METHOD

BACKGROUND OF THE INVENTION

1. Field of the Invention

This invention relates generally to an apparatus for spraying liquids and more particularly to liquid sprayers having multiple nozzles alternatively usable to control spray configuration.

2. Description of Related Art

Power washers are commonly used to spray water at a high pressure to facilitate the cleaning of certain surfaces. These surfaces may include concrete sidewalks and driveways, house and building exteriors, cars and equipment, for example. Chemicals can be commingled with the water to facilitate cleaning. For example, cleaning of delicate surfaces can be facilitated with the addition of soap, and degreasers can be added to facilitate the cleaning of equipment.

Power washers commonly include an engine or motor which is used to drive a pump. Water is input to the pump typically at a relatively low city water pressure, and output from the pump at a relatively higher pressure. Portability of these systems is facilitated by use of an engine rather than a motor, and by mounting the engine and the pump on a wheeled cart. An elongate high-pressure hose is connected to the output of the pump and communicates the water under pressure to a distal end where the hose is coupled to a wand operable by a user.

The wand will typically include an elongate tube having a proximal end and a distal end. At the proximal end, the wand includes a handle and valve assembly which is connected to the distal end of the hose. At the distal end of the tube, the wand will typically have a nozzle which controls the configuration of the spray. In order to provide a variety of spray configurations, multiple nozzles are often provided for the user. These nozzles are alternatively attachable to and removable from the distal end of the wand. Screw attachments are common but a quick release system is particularly advantageous. This quick release system typically includes a female connector permanently attached to the distal end of the wand, and multiple male couplings each attached to an associated nozzle.

For a given application, there may be as many as six or seven nozzles specifically adapted to produce different spray configurations. With all these nozzles available, it is particularly desirable to have them readily available to the user. In the past, the multiple nozzles have been carried on the cart with the engine and pump. In order for a user to change nozzles on the wand, it has been necessary to return to the cart typically with the wand in hand in order to change the nozzle in use. This procedure is complicated by objects which are disposed near the surface being cleaned. For example, in cleaning a concrete patio, the user is commonly around automatic sprinklers which extend above the surface of the patio. In an attempt to return to the area of the cart and thereby facilitate nozzle exchange, the pressure hose can easily become entangled in such objects thereby complicating the process and increasing the time and aggravation associated with nozzle exchange. As an alternative, users have tended to collect the nozzles in a pants or shirt pocket. In order to facilitate a nozzle exchange, all of the nozzles must be removed in order to find the particular nozzle desired. This has also been a cumbersome approach to nozzle exchange but at least has avoided the problems associated with returning to the cart.

SUMMARY OF THE INVENTION

These deficiencies of the past are overcome with the present invention which includes a nozzle retainer adapted to be disposed at the distal end of a delivery system when it is easily accessible to a user. In a delivery system including a flexible hose and a wand, the retainer can be disposed in proximity to a handle of the wand which is held by the user.

The retainer typically includes a base plate having a plurality of circumferential holes each of which is adapted to receive a rubber grommet. Nozzles typically formed of a cylindrical coupling and an annular recess are removably held within the grommets. An annular recess commonly associated with the nozzles readily aligns with the plane of the base plate to facilitate gripping and removal of the nozzles from the base plate.

In a delivery system consisting of a hose, handle and spray tube, the retainer can be disposed in the fluid flow path between the spray tube and handle or the handle and hose. Alternatively, a rotatable version of the retainer can be attached to the spray tube in proximity to the handle. A nozzle cleaner can be provided with the size and configuration of the nozzles on the retainer.

In one aspect of the invention, a fluid spray apparatus includes a pump providing a source of fluid at an elevated pressure, and a delivery system having an elongate configuration with a proximal end coupled to the pump. A distal end of the delivery system expels the fluid in a predetermined spray pattern. A nozzle receiver can be included in the delivery system along with a plurality of nozzles each adapted to couple to the receiver and provide an associated spray pattern. A nozzle retainer is attached to the delivery system and adapted to releasably retain the nozzles in proximity to the distal end of the delivery system.

In another aspect of the invention, a flexible hose is included in the delivery system with a proximal end and a distal end, the proximal end being coupled to the pump. A wand included in the delivery system includes a handle coupled to the distal end of the hose and an elongate tube is attached to the handle for expelling the fluid in a predetermined pattern. This pattern is controlled by one of a plurality of nozzles each of which is adapted to provide the spray with a different pattern. These nozzles can be releasably retained by a retainer disposed in proximity to the handle.

In a further aspect a method for changing the spray pattern of a fluid spray apparatus comprises the steps of introducing a fluid under pressure into a proximal end of an elongate delivery system. This fluid is then expelled under pressure from the distal end of the delivery system in a spray having a predetermined pattern. A plurality of nozzles are provided each having properties coupled to the distal end of the delivery system to provide the spray with a different associated pattern. The nozzles are retained when not in use in an ordered pattern by the retainer which is disposed in proximity to the distal end of the delivery system. Removing a predetermined nozzle from the retainer enables a user to mount the nozzle on the distal end of the delivery system to provide the spray with the desired configuration.

In a further aspect of the invention a combination includes a nozzle with a spray orifice and a cylindrical coupler sized and configured to be held in a receiver. A nozzle cleaner having a cleaning pin also includes a cylindrical coupler having generally the same size and shape of the coupler of the nozzle. A nozzle retainer has a hole which is sized and configured to receive the coupler of the nozzle and the coupler of the nozzle cleaner.

The nozzle cleaner includes a carrier, a pin having a fixed relationship with the carrier and a guard pivotally mounted relative to the carrier. The guard is adapted to move between a first position wherein the guard covers the pin and a second position wherein the guard is removed to expose the pin for cleaning the orifice of a nozzle.

These and other features and advantages of the invention will be better understood with reference to preferred embodiments of the invention and reference to the associated drawings.

DESCRIPTION OF THE PREFERRED EMBODIMENTS AND BEST MODE OF THE INVENTION

Figure 1:
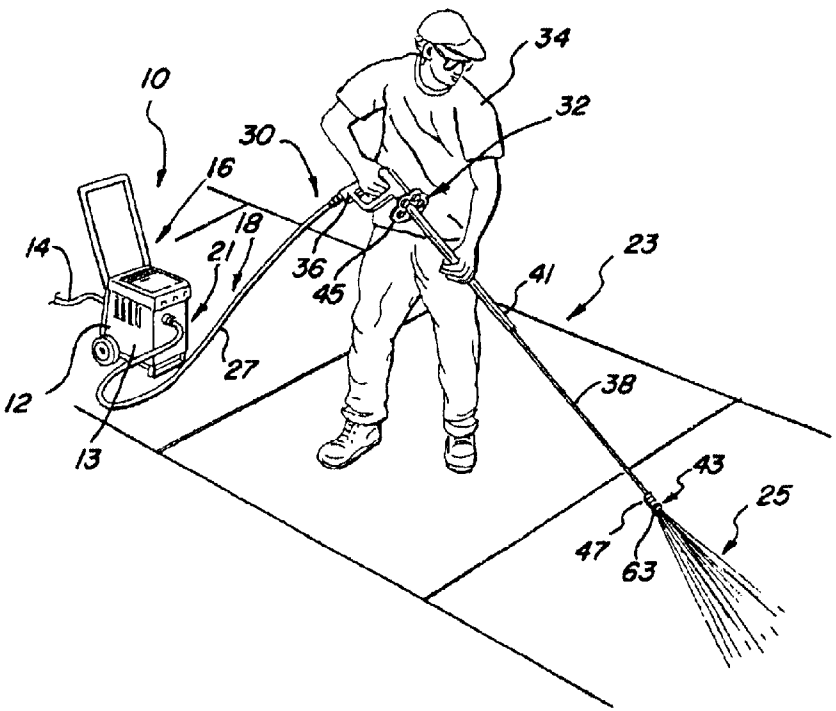
FIG. 1 is a perspective view showing a fluid spray apparatus including a delivery system with a flexible hose and a wand.

A fluid spray apparatus or power washer is illustrated in FIG. 1 and designated by the reference numeral 10. In this case, the apparatus 10 includes a pump 12 receiving water for example from a garden hose 14. An engine coupled to the pump 12 is carried on a portable cart 16 to facilitate portability of the apparatus 10. A delivery system 18 has an elongate configuration and includes a proximal end 21 and distal end 22. The proximal end 21 is coupled to the pump 23 where it is adapted to receive water under pressure. The distal end 25 of the delivery system 18 expels the pressurized water in a spray 25 having a predetermined spray configuration.

The power washer in this case is merely representative of several types of fluid spray apparatus 10 which provide a fluid under pressure for various purposes. The fluid, which may either be a fluid or a gas, is commonly pressurized for delivery to a predetermined location. The power washer of the type illustrated in FIG. 1 is commonly used to provide water under pressure for cleaning sidewalks, driveways, building siding, and other surfaces. Depending on the surface being treated and the desired pressure, the spray 25 can be provided with different configurations in the manner described in greater detail below.

In the illustrated embodiment, the delivery system 18 includes a flexible hose 27 which is coupled to the pump 12 on the cart 16. A distal end 30 of the hose 27 is typically coupled to a wand 32 which is held by a user 34. The wand 32 in this embodiment includes a handle 36 and elongate tube 38 which extends through a grip 41 and terminates at a nozzle assembly 43 in this particular embodiment. A nozzle retainer 45 is disposed between the handle 36 and the tube 38. In operation, the delivery system 18 delivers a flow of the fluid under pressure from the pump 12 through the hose 27 and a control valve in the handle 36 and outwardly through the nozzle assembly 43.

Figure 2:
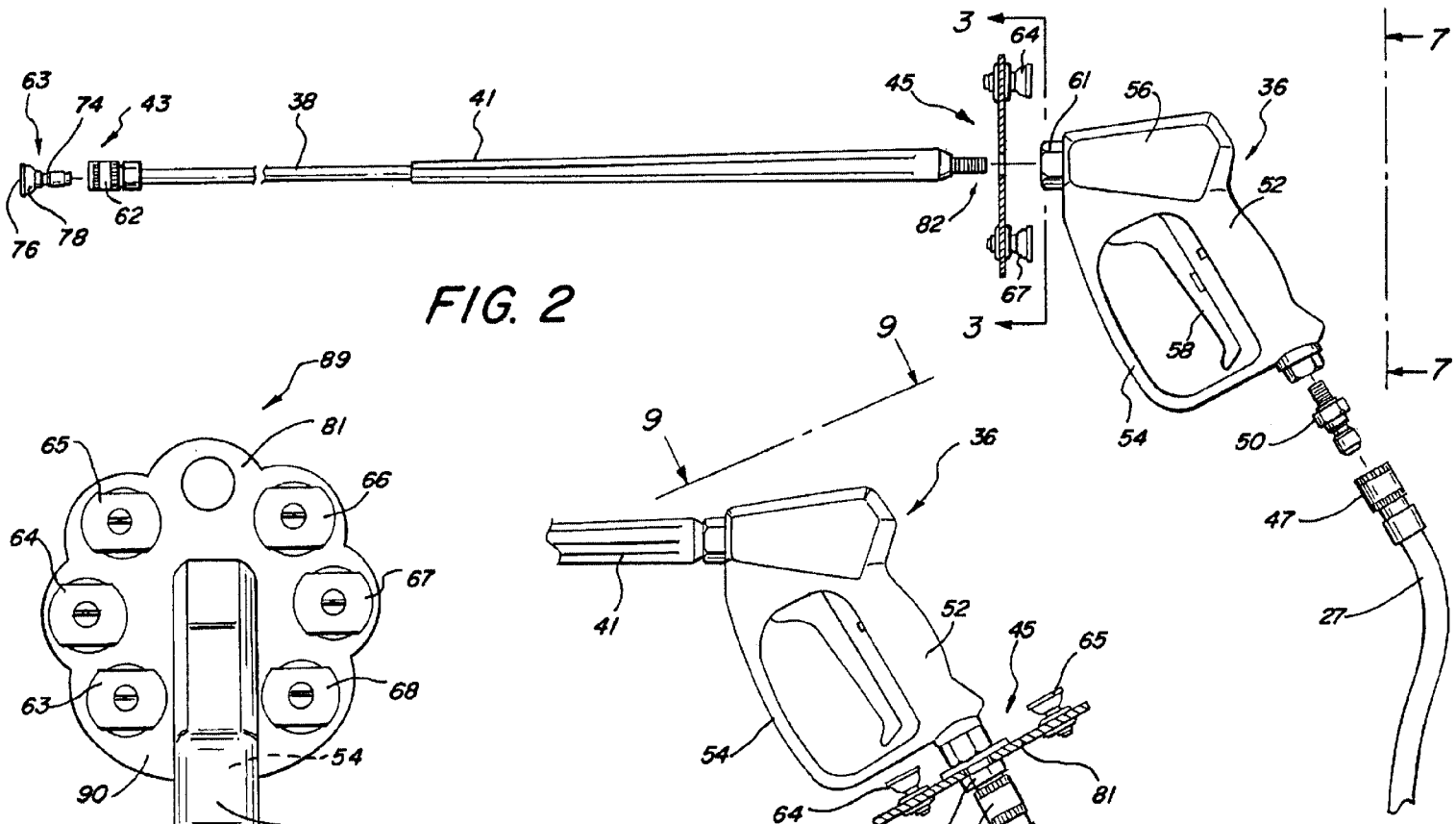
FIG. 2 is a side elevation view of the wand illustrated in FIG. 1 and showing a preferred embodiment with a nozzle retainer disposed between a spray tube and a handle of the wand.

The nozzle retainer 45 is illustrated in greater detail in the side elevation view of FIG. 2. In this view it can be seen that the hose 27 can be provided at its distal end 30 with a quick disconnect receiver 47 which is adapted to receive a quick disconnect coupling 50 fixed to the handle 36.

The handle 36 in this embodiment includes a palm grip 52 and finger guard 54. A valve 56 is operable by a movable lever 58. With this configuration, the flow of water enters the handle through the connector 50 and is directed through the palm grip 52 for control by the valve 56. When the valve is open, the flow of fluid is expelled from the handle 36 at an outlet 61. In this embodiment, the elongate tube 38 extends through the grip 41 and is screwed into the outlet 61 of the handle 36.

At its distal end, the tube 38 can be provided with the nozzle assembly 43 which in the illustrated embodiment includes a quick disconnect receiver 62 and a plurality of nozzles numbered consecutively with the reference numerals 63–68. These nozzles 63–68 each have properties for providing the spray 25 (FIG. 1) with a different configuration. Thus, the user 34 need only change the nozzle coupled to the receiver 62 in order to change the pattern of the spray 25. It can be appreciated that with this type of system, it is desirable to provide all of the nozzles 63–68 in a single ordered arrangement somewhere in proximity to the user 34 near the distal end of the delivery system 18. This is one of the purposes of the nozzle retainer 45 which in the embodiment of FIG. 2 is disposed between the handle 36 and the elongate tube 38.

The nozzles 63–68 typically include a short coupling 72 with a cylindrical configuration and an annular recess 74, both adapted for receipt in the quick disconnect receiver 62. The cylindrical coupling 72 will typically extend distally to an orifice 76 which is surrounded by an enlargement 78.

Figure 3:
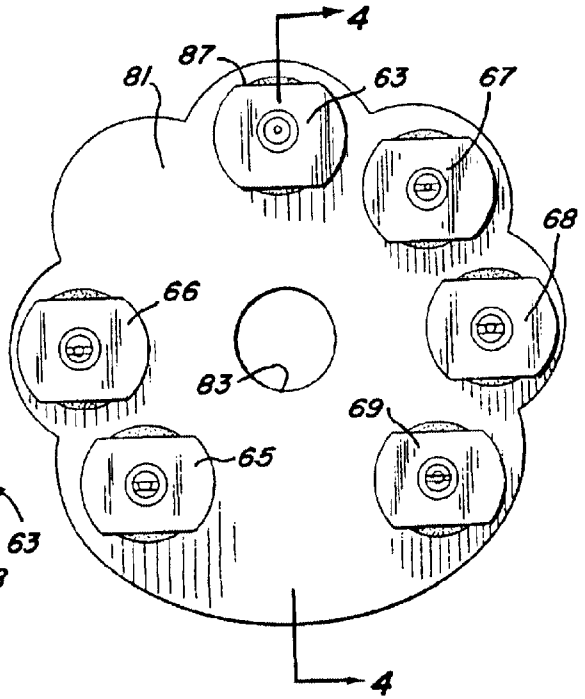
FIG. 3 is an elevation view taken along lines 3—3 of FIG. 2.
Figure 4:
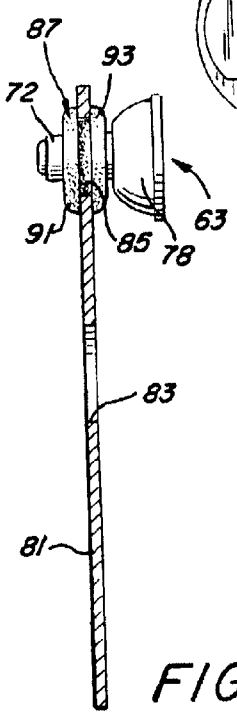
FIG. 4 is an axially cross-section view taken along lines 4—4 of FIG. 3.

This retainer 45 is perhaps best illustrated in the front elevation view of FIG. 3 and the enlarged side elevation view of FIG. 4. From these views it can be seen that a preferred embodiment of the retainer 45 includes a base plate 81 which in this case has a generally planar configuration. The base plate 81 is provided with a mounting aperture 83 and also with a plurality of holes (only one of which is illustrated in FIG. 4 and designated by the reference numeral 85). The hole 85 is preferably filled with a rubber grommet 87 having flanges 91 and 93 which extend on opposite sides of the base plate 81. The diameter of the hole 85 and grommet 87 are chosen to facilitate the snug receipt of the cylindrical coupling 72 associated with one of the nozzles, such as the nozzle 63. Since these cylindrical coupling 72 for each of the nozzles 63–68 will have the same diameter, holes similar to the hole 85 and grommets similar to the grommet 87 can be provided in an ordered arrangement on the base plate 81 in order to accommodate each of the nozzles 63–68 when not in use.

Figures 5, 6, 9, 10, 11, 12, 13, 14:
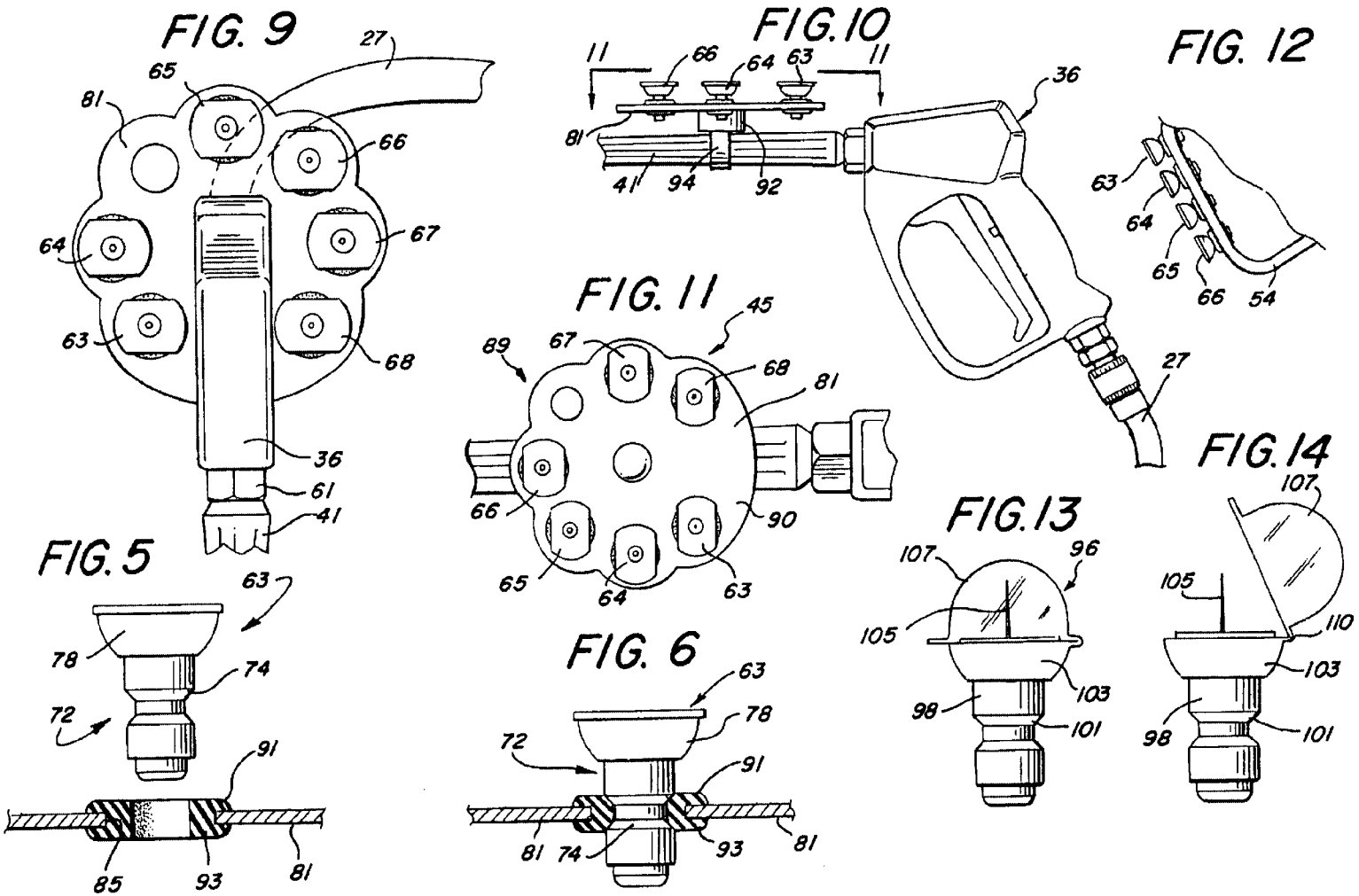
FIG. 5 is a cross-section view showing the retainer prior to insertion of a nozzle.
FIG. 6 is a side elevation view similar to FIG. 5 showing the retainer with nozzle inserted.
FIG. 9 is a top plan view taken along lines 9—9 of FIG. 8.
FIG. 10 is a side elevation view of a further embodiment wherein the nozzle retainer is pivotally mounted on a spray tube of the wand.
FIG. 11 is a top plan view of the retainer taken along lines 11—11 of FIG. 10.
FIG. 12 is a side elevation view of the finger guard associated with the wand of the handle wherein the nozzles are aligned on the finger guard.
FIG. 13 is a axial cross-section view of a nozzle cleaner with a dome disposed in a closed position to cover a cleaning pin.
FIG. 14 is an axial cross-section view similar to FIG. 13 and showing the dome in an open configuration to expose the cleaning pin.

With reference to FIGS. 5 and 6, it will be appreciated that this snug relationship can be facilitated by forming the base plate 81 with a thickness which is generally equal to or smaller than the axial width of the annular groove 74 in the coupling 72. This will enable the grommet 87 to spread from its natural state illustrated in FIG. 5 to its expanded state illustrated in FIG. 6. With the flanges 91 and 93 free to expand radially, only that portion of the grommet 87 which is disposed inwardly of the hole 85 will be retained in its generally fixed diameter. With this structure, the nozzle, such as the nozzle 63, can be pushed into the grommet where it will tend to center with the annular groove 74 in the plane of the base 81. With the nozzle 63 thus retained, the enlargement 78 is spaced sufficiently from the base 81 that it can be easily engaged by the fingers of the user 34 for removal. In the embodiment of FIG. 3 the attachment mechanism 82 includes the threaded proximal end of the tube 38 and the threaded orifice 61 associated with the handle 36.

Figure 7:
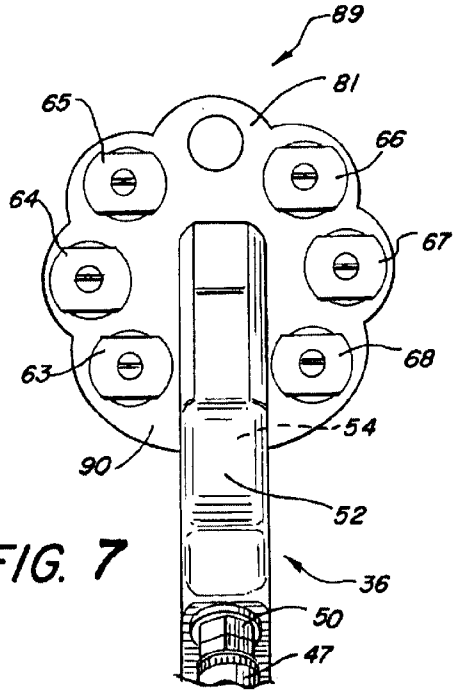
FIG. 7 is a side elevation view taken along lines 7—7 of FIG. 2.

As noted, the retainer 45 can be disposed between the handle 36 and the elongate tube 38 of the wand 32 by an attachment mechanism 82. In this position, also illustrated in the view of FIG. 7, it can be appreciated that the base plate 81 may include portions 89 which are easily accessible and therefore adapted for retention of the nozzles 63—68. A portion of the base plate 81 is less accessible due to its proximity with the finger guard 54. This portion is designated by the reference numeral 90 in FIG. 7. Preferably, the nozzle retainer 45 is mounted with this portion 90 disposed in closest proximity to the finger guard 54.

Figure 8:
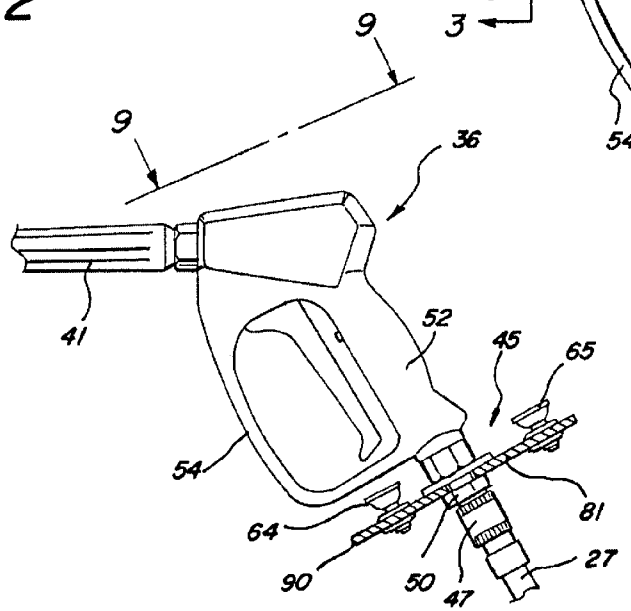
FIG. 8 is a side elevation view of a further embodiment wherein the nozzle retainer is disposed between the handle of the wand and the flexible hose.

In another embodiment illustrated in FIGS. 8 and 9, the nozzle retainer 45 is disposed between the palm grip 52 and the coupling 50. In this location, the portion 90 of the base plate 81 is also preferably disposed in proximity to the finger guard 54. In the embodiment of FIG. 8, the attachment mechanism 82 includes the threaded distal end of the coupling 50 and the threaded proximal end of the palm grip 52. A view taken along lines 9—9 of FIG. 8 is illustrated in FIG. 9.

In a further embodiment of the invention illustrated in FIGS. 10 and 11, the attachment mechanism 82 of the nozzle retainer 45 includes a pivot post 92 which can be attached to the grip 41, for example by a band 94. As best illustrated in the top plan view of FIG. 11, the base plate 81 of the nozzle retainer 45 can be formed with all portions 87 accessible. In this case, the holes and grommet, such as the hole 85 and grommet 87 of FIG. 4, can be equally angularly spaced around the circumference of the base plate 81. Importantly, the base plate 81 can be made to rotate on the pivot post 92 in order to facilitate access to a particular one of the nozzles 63–68.

In still a further embodiment, the nozzles can be retained directly on the finger guard 54 as illustrated in FIG. 12. In this embodiment holes, such as the hole 85, can be filled with an associated grommet, such as the grommet 87, and aligned along the finger guard 54. In the manner previously discussed, the nozzles 63–68 can be removably retained on the finger guard 54 in proximity to the distal end 23 of the delivery system 18.

Another aspect associated with the present invention is associated with the cleaning of the nozzles 63–68. As noted, these nozzles will typically have a very small orifice 76 (FIG. 2) through which the fluid is expelled in a predetermined pattern. Any debris carried in the fluid flow tends to collect in the nozzle 74 upstream of the orifice 76.

In accordance with the present invention, a cleaning tool is provided with the same general configuration as the nozzles 63–68. Thus, a nozzle cleaner 96 may include a cylindrical coupling 98, similar to the coupling 72, and an associated annular recess 101 similar to the recess 74. A circular carrier 103 can be fixed to the cylindrical coupler 98 and molded to retain a cleaning pin 105. Since the pin 105 will have a very small diameter, it may be desirable to provide a guard 107 to cover the pin 105 when it is not in use. The guard 107 can form a dome over the pin 105 and carrier 103, as illustrated in FIG. 13. When it is desired to use the nozzle cleaner 96, the guard 107 can be pivoted on a living hinge 1 10 to expose the pin 105. It may be desirable to retain the guard 107 in this pivoted open position using a detent between the carrier 103 and guard 107.

By providing the nozzle cleaner 96 with a configuration similar to that of the nozzles 63–68, the cleaner 96 can also be releasably held by the nozzle retainer 45.

From the foregoing description of preferred embodiments it will be apparent that many of the advantages associated with the present invention can be achieved without departing from the spirit and scope of the invention. Therefore, it must be understood that the illustrated embodiments have been set forth only for the purposes of example and should not be taken as limiting the invention. Accordingly, one is cautioned not to limit the concept only to those embodiments disclosed, but rather to determine the scope of the invention only with reference to the following claims.

What is claimed is:

1. A fluid spray apparatus, comprising:

a pump providing a source of the fluid at an elevated pressure;

a wand having an elongate configuration with a proximal end and a distal end, the wand being coupled at the proximal end to the pump; and having properties at the distal end for expelling the fluid under pressure from the end in a predetermined spray pattern;

a nozzle receiver included in the wand and being disposed at the distal end of the wand;

a plurality of nozzles each adapted to be individually coupled to the nozzle receiver and to provide the spray pattern with an associated configuration;

a nozzle retainer coupled to the wand in proximity to the proximal end of the wand; and the nozzle retainer being adapted to releasably retain the nozzles in proximity to the proximal end of the wand and thereby facilitate a change of the nozzles and the associated spray patterns.

2. The fluid spray apparatus recited in claim 1 wherein the nozzle retainer includes:

a base plate adapted to receive the nozzles; and an attachment mechanism for coupling the base plate to the wand in proximity to the proximal end of the wand.

3. The fluid apparatus recited in claim 2 wherein the base plate is adapted to receive the nozzles in an ordered pattern.

4. The fluid spray apparatus recited in claim 2 wherein the base plate rotates relative to the attachment mechanism.

5. The fluid spray apparatus recited in claim 2 wherein the fluid flow path extends through one of the base plate and the attachment mechanism.

6. The fluid spray apparatus recited in claim 5 wherein the fluid flow path extends through the base plate.

7. A fluid spray apparatus, comprising:

a pump providing a source of the fluid at an elevated pressure;

a delivery system coupled to the pump for distributing the fluid under pressure to a desired location;

a flexible hose included in the delivery system and having a proximal end and a distal end, the proximal end of the hose being coupled to the pump;

a wand included in the delivery system and being coupled to the distal end of the hose;

a handle included in the wand and being coupled to the hose;

an elongate tube coupled to the handle at a proximal end and being adapted to expel the fluid from its distal end in a spray;

a plurality of nozzles each adapted to be coupled to the distal end of the tube and each having characteristics for providing the spray with a different pattern; and a retainer disposed in proximity to the handle for releasably retaining the nozzles in proximity to the distal end of the hose when the nozzles are not coupled to the tube.

8. The fluid spray apparatus recited in claim 7 wherein the delivery system includes:

a base adapted to releasably retain the nozzles; and an attachment mechanism for coupling the base to one of the handle and the elongate tube.

9. The fluid spray apparatus recited in claim 8 wherein the attachment mechanism couples the base to the elongate tube.

10. The fluid spray apparatus recited in claim 8 wherein the attachment mechanism is coupled to the handle.

11. The fluid spray apparatus recited in claim 9 wherein the base is rotatable relative to the attachment mechanism.

12. The fluid spray apparatus recited in claim 10 wherein the attachment mechanism is disposed between the handle and the elongate tube.

13. The fluid spray apparatus recited in claim 10 wherein the attachment mechanism is disposed between the handle and the flexible hose.

14. A method for changing the spray pattern of a fluid spray apparatus, comprising the steps of:

introducing a fluid under pressure into a proximal end of an elongate delivery system including a handle operating the hand to expel the fluid under pressure from a distal end of the elongate delivery system in a spray having a predetermined pattern;

providing a plurality of nozzles each having properties for being coupled to the distal end of the delivery system to provide the spray with a different associated pattern;

retaining the nozzles when not in use in an ordered pattern relative to a retainer, the retainer being disposed in proximity to the handle of the delivery system;

removing a predetermined nozzle from the retainer;

mounting the predetermined nozzle on the distal end of the delivery system to provide the spray with the configuration associated with the predetermined nozzle.

15. The method recited in claim 14 wherein the mounting step includes the steps of:

providing the retainer with a base and an attachment mechanism; and coupling the attachment mechanism to the delivery system in proximity to the handle of the delivery system.

16. The method recited in claim 15 wherein the removing step includes the step of:

rotating the base relative to the attachment mechanism.

17. The method recited in claim 15 wherein the delivery system defines a fluid flow and the mounting step further comprises the step of:

mounting the retainer with the fluid flow directed through the base.

18. A fluid spray apparatus, comprising:

a pump providing a source of the fluid at an elevated pressure;

a delivery system coupled to the pump for distributing the fluid under pressure to a desired location;

a flexible hose included in the delivery system and having a proximal end and a distal end, the proximal end of the hose being coupled to the pump;

a wand included in the delivery system;

a handle included in the wand and being coupled to the hose;

an elongate tube extending from the handle and being configured to expel the fluid in a spray;

a plurality of nozzles each adapted to be operably coupled to the tube to provide the spray with a different pattern; and a retainer for releasably retaining the nozzles in proximity to the handle when the nozzles are not operably coupled to the tube.

* * * * *